US010859951B2

(12) United States Patent
Matsuo et al.

(10) Patent No.: US 10,859,951 B2
(45) Date of Patent: Dec. 8, 2020

(54) ELECTROPHOTOGRAPHIC BELT HAVING GROOVES AND ELECTROPHOTOGRAPHIC IMAGE FORMING APPARATUS

(71) Applicant: CANON KABUSHIKI KAISHA, Tokyo (JP)

(72) Inventors: Yasuhiro Matsuo, Kawasaki (JP); Kouichi Uchida, Yokohama (JP); Masatsugu Toyonori, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/855,029

(22) Filed: Apr. 22, 2020

(65) Prior Publication Data

US 2020/0341408 A1 Oct. 29, 2020

(30) Foreign Application Priority Data

Apr. 26, 2019 (JP) ..... 2019-086279

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162
USPC ..... 399/101, 302
See application file for complete search history.

(56) References Cited

U.S. PATENT DOCUMENTS 7,266,329 B2 * 9/2007 Matsuo et al. ..... G03G 21/0005 399/302
9,034,476 B2 5/2015 Uchida et al.
9,195,176 B2 * 11/2015 Seki et al. ..... G03G 15/161
9,261,803 B2 2/2016 Uchida
9,744,732 B2 8/2017 Uchida
9,753,411 B2 9/2017 Uchida et al.
10,551,771 B2 2/2020 Uchida et al.
10,606,190 B2 * 3/2020 Yoshida et al. ..... G03G 15/162
(Continued)

FOREIGN PATENT DOCUMENTS

JP 2014-219505 11/2014
JP 2015-125187 7/2015
JP 2016-186582 10/2016

OTHER PUBLICATIONS

U.S. Appl. No. 16/699,835, Kouichi Uchida, filed Dec. 2, 2019.

*Primary Examiner* — William J Royer
(74) *Attorney, Agent, or Firm* — Venable LLP

(57) ABSTRACT

An electrophotographic belt that, despite long-term usage, is not susceptible to unevenness in cleaning by a cleaning blade in a width direction. The electrophotographic belt has an endless shape and has grooves on an outer circumferential surface thereof, the grooves each extending in a circumferential direction of the electrophotographic belt, when equally dividing a groove-formed area of the outer circumferential surface into three areas in a direction orthogonal to the circumferential direction of the electrophotographic belt, and calculating average values of depths of the grooves contained in the three areas respectively to obtain Dm, De1 and De2, where Dm is an average value of depths of the grooves in a central area, De1 and De2 are average values of depths of the grooves contained in both ends areas, Dm, De1 and De2 satisfy equations (1) and (2):

$$Dm<De1 \quad (1)$$

$$Dm<De2 \quad (2).$$

10 Claims, 9 Drawing Sheets

(56) References Cited

U.S. PATENT DOCUMENTS

| | | | | |
|---|---|---|---|---|
| 10,642,195 | B2 * | 5/2020 | Ishio et al. ..... | G03G 15/161 |
| 10,656,567 | B1 * | 5/2020 | Igarashi et al. ..... | G03G 15/162 |
| 10,725,402 | B2 * | 7/2020 | Ishizumi et al. ..... | G03G 15/161 |
| 2014/0197578 | A1 | 7/2014 | Uchida | |
| 2020/0174405 | A1 | 6/2020 | Uchida et al. | |

* cited by examiner

ELECTROPHOTOGRAPHIC BELT HAVING GROOVES AND ELECTROPHOTOGRAPHIC IMAGE FORMING APPARATUS

BACKGROUND OF THE INVENTION

Field of the Invention

The present disclosure relates to an electrophotographic belt such as a conveyance transfer belt or an intermediate transfer belt which is used in an electrophotographic image forming apparatus such as a copying machine or a printer, and the like, and relates to an electrophotographic image forming apparatus.

Description of the Related Art

In an electrophotographic image forming apparatus, an electrophotographic belt having an endless shape is used as a conveyance transfer belt that conveys transfer material or as an intermediate transfer belt that temporarily transfers and retains a toner image.

Toner that remains on an outer surface of an electrophotographic belt even after a secondary transfer is normally cleaned using a cleaning member such as a cleaning blade.

Japanese Patent Application Laid-Open No. 2015-125187 discloses, as an intermediate transfer body used in an image forming apparatus that enables suppression of abrasion of a cleaning member while improving the efficiency with which toner is transferred from the intermediate transfer body to a transfer material, the intermediate transfer body in the surface of which grooves are formed along the direction of movement of the intermediate transfer body.

SUMMARY OF THE INVENTION

One embodiment of the present disclosure is directed to providing an electrophotographic belt that, despite long-term usage, is not susceptible to unevenness in cleaning by a cleaning blade in a width direction.

Furthermore, another embodiment of the present disclosure is directed to providing an electrophotographic image forming apparatus that enables high-quality electrophotographic images to be formed stably over long periods.

One embodiment of the present disclosure provides an electrophotographic belt having an endless shape, the electrophotographic belt having grooves on an outer circumferential surface thereof, the grooves each extending in a circumferential direction of the electrophotographic belt, wherein, when equally dividing a groove-formed area of the outer circumferential surface into three areas in a direction orthogonal to the circumferential direction of the electrophotographic belt, i.e. a width direction, and calculating average values of depths of the grooves contained in the three areas respectively to obtain Dm, De1 and De2, where Dm is an average value of depths of the grooves in a central area, De1 and De2 are average values of depths of the grooves contained in both ends areas, Dm, De1 and De2 satisfy equations (1) and (2):

$$Dm<De1 \quad (1)$$

$$Dm<De2 \quad (2).$$

Another embodiment of the present disclosure provides an electrophotographic image forming apparatus having the afore-mentioned electrophotographic belt and a cleaning member disposed in contact with the outer circumferential surface of the electrophotographic belt is provided.

Further features of the present disclosure will become apparent from the following description of exemplary embodiments with reference to the attached drawings.

DESCRIPTION OF THE EMBODIMENTS

The inventors reviewed the cleaning properties of an outer surface of an intermediate transfer belt according to Japanese Patent Application Laid-Open No. 2015-125187 using a cleaning blade. The result of the review was that there was unevenness in the cleaning in a middle section and at both ends in a direction orthogonal to a circumferential direction of the intermediate transfer belt (hereinafter sometimes called the "width direction") due to long-term usage.

Therefore, the inventors reviewed the reason for the unevenness, due to long-term usage, in the cleaning in the middle section and at both ends, in a width direction, of the intermediate transfer belt according to Japanese Patent Application Laid-Open No. 2015-125187.

Figure 9:
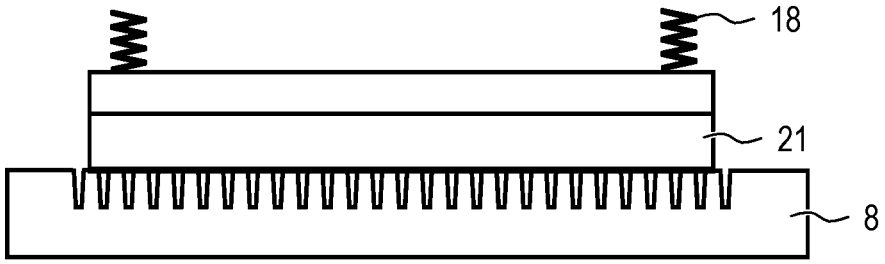
FIG. 9 is an explanatory diagram illustrating a state where a cleaning blade is in contact with a surface of a conventional intermediate transfer belt.

Consequently, it was discovered that a frictional force between the surface of the intermediate transfer belt and the cleaning blade increased due to the surface grooves becoming shallow as a result of abrasion of the surface at both ends, in the width direction, of the intermediate transfer belt resulting from long-term usage. That is, as illustrated in FIG. 9, in an electrophotographic image forming apparatus, a cleaning blade 21 is pressed against the surface of an intermediate transfer belt 8 by two springs 18 disposed at the two respective ends thereof in the width direction. Hence, the pressing force of the cleaning blade 21 against the surface of the intermediate transfer belt 8 is high at both ends in comparison with the middle section in the width direction. Consequently, through long-term usage, the surface at both ends of the intermediate transfer belt 8 is worn down relatively sooner than the surface of the middle section. Thus, the depth of the grooves at both ends grows shallow sooner than the depth of the grooves in the middle section and, consequently, the frictional force at both ends is high and may be considered to be the reason for the difference in cleaning properties between the two ends and the middle section in the width direction.

Therefore, in the electrophotographic belt according to one embodiment of the present disclosure, a groove-formed area of the outer circumferential surface is equally divided into three areas so that each of the areas has equal width in a direction orthogonal to the circumferential direction of the electrophotographic belt. Hereinafter, the direction orthogonal to the circumferential direction of the electrophotographic belt may be referred to as "width direction". In addition, when an average value of depths of the grooves contained in a central area among the three areas is defined as Dm, and an average values of depths of the grooves contained in both ends areas among the three areas are defined as De1 and De2 respectively, Dm, De1, and De2 satisfy the equations (1) and (2):

$$Dm<De1 \quad (1)$$

$$Dm<De2 \quad (2).$$

By adopting this kind of configuration, it is possible to prevent the grooves at both ends from being worn down early in comparison with the grooves in the middle section despite long-term usage, and the generation of cleaning unevenness can be suppressed.

An example of an intermediate transfer belt constituting one embodiment of the electrophotographic belt according to the present disclosure, a method for manufacturing the intermediate transfer belt, and an electrophotographic image forming apparatus according to another embodiment of the present disclosure will be described in further detail hereinbelow as per the drawings. However, the present disclosure is not limited to or by the one example described hereinbelow.

1. Intermediate Transfer Belt

Figure 3:
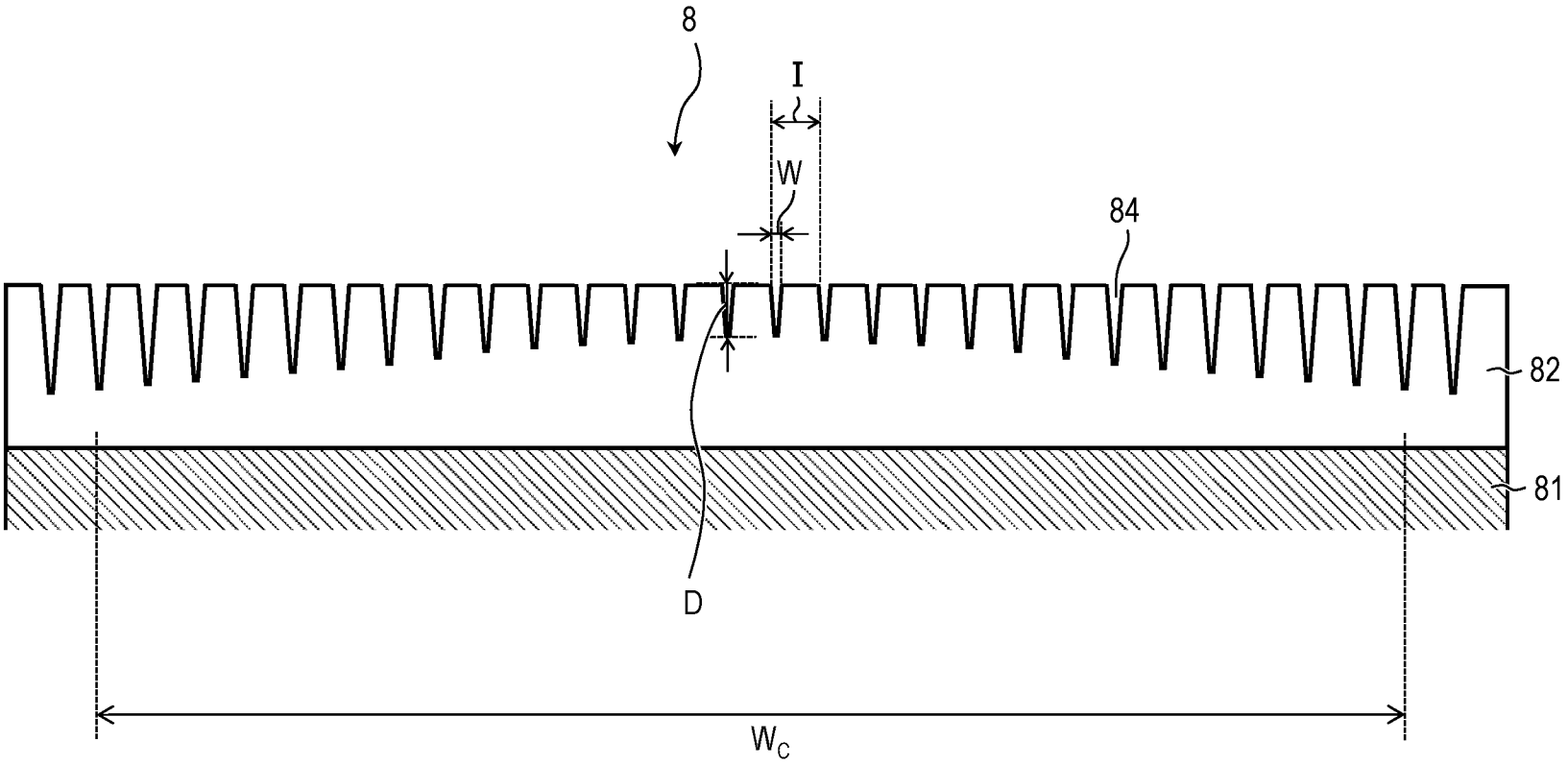
FIG. 3 is a schematic cross-sectional view illustrating an example of an electrophotographic belt having an endless shape according to one embodiment of the present disclosure.

A configuration of and a method for manufacturing the intermediate transfer belt 8 constituting an example of the electrophotographic belt having an endless shape according to one embodiment of the present disclosure will be described. FIG. 3 is a partial exploded view of a cut face, in a direction substantially orthogonal to the circumferential direction, of the intermediate transfer belt 8. The intermediate transfer belt 8 is an endless belt member including two layers, namely, a base layer 81 and a surface layer 82. The thickness of the base layer 81 is preferably 10 μm or more and 500 μm or less, and particularly preferably 30 μm or more and 150 μm or less. The thickness of the surface layer 82 is preferably 0.5 μm or more and 5 μm or less, and particularly preferably 1 μm or more and 3 μm or less.

Possible materials for the base layer 81 include, for example, thermoplastic resins such as polycarbonates, poly (vinylidene fluoride)(PVDF), polyethylene, polypropylene, polymethylpentene-1, polystyrene, polyamides, polysulfones, polyarylates, polyethylene terephthalate, polybutylene terephthalate, polyethylene naphthalate, polybutylene naphthalate, polyphenylene sulfide, polyethersulfone, polyethernitrile, thermoplastic polyimides, polyether ether ketone, thermotropic liquid-crystal polymers, and polyamide acid. A mixture of two or more of the foregoing resin types may also be used.

As the method for manufacturing the base layer 81, a conductive material or the like can be melted and kneaded into these thermoplastic resins and then a molding method such as inflation molding, cylinder extrusion molding, or blow molding can be selected, as appropriate, to obtain the base layer 81.

As the material of the surface layer 82, a curable material that is cured by being irradiated with heat or an energy beam such as an electron beam or light (ultraviolet rays or the like) may suitably be used from the perspective of raising the hardness of the surface of the intermediate transfer belt 8 to improve durability (abrasion resistance). In particular, a curable material that is highly curable and is cured by being irradiated with ultraviolet rays or an electron beam or the like is preferable. Among curable materials, possible organic materials include curable resins such as melamine resin, urethane resins, alkyd resins, acrylic resins, and fluorine-based curable resins (fluorinated curable resins).

Possible methods for forming the surface layer 82 atop the base layer 81 include, for example, dip coating, spray coating, roll coating, spin coating, and ring coating, and the like. By suitably selecting and employing a method from among these methods, a surface layer 82 of the desired film thickness may be obtained.

The intermediate transfer belt 8 has grooves 84 in the outer circumferential surface, and the grooves 84 each extend in the circumferential direction of the intermediate transfer belt 8. That is, the grooves 84 extending in the circumferential direction of the intermediate transfer belt 8 are configured from the outer surface of the surface layer 82. For example, the pitches of the grooves 84 (hereinafter also called "groove-pitches") extending in the circumferential direction of the intermediate transfer belt 8 and in the outer surface of the intermediate transfer belt 8 are preferably constant in the width direction.

Furthermore, the shape of the grooves 84 is suitably set for the combination of a cleaning blade 21 and a toner, but when the groove-pitches are a pitch I, pitch I is preferably in a range of 1 μm or more and 50 μm or less.

In addition, when the length of the opening of the grooves 84 in the width direction of the intermediate transfer belt 8 is a width W, the width W is preferably 0.10 μm or more and 3.0 μm or less, and a depth D is preferably 0.2 μm or more and 3.0 μm or less.

The cleaning blade 21 is in contact with the outer circumferential surface of the intermediate transfer belt 8 and the outer circumferential surface is cleaned by the cleaning blade 21. A pressing force of the cleaning blade 21 that acts on the outer circumferential surface of the intermediate transfer belt 8 tends to be higher at the ends where pressure springs 18 are disposed than in the middle section along the longitudinal direction (the width direction of the intermediate transfer belt 8). Therefore, the depth of the grooves 84 constituted in the outer surface of the intermediate transfer belt 8 is preferably deeper at the ends than in the middle section along the longitudinal direction, in accordance with the tendency for the pressing force to be high at the ends, and preferably improves durability to abrasion. Alternatively, rendering the depth of the grooves 84 deep only at the ends where the pressing force of the cleaning blade 21 is high is also preferable.

Possible ways for making the depth of the grooves 84 deep at the ends of the intermediate transfer belt 8, include, for example, centrifugal molding, casting, and imprinting, in which the shape of the mold surface is transferred by contacting the mold, for example. Among such methods, imprinting is particularly desirable in giving the mold surface the desired shape or enabling the desired shape of the grooves 84 to be obtained by utilizing elastic deformation or thermal expansion to transfer the shape.

The depth D of the grooves 84 is preferably deeper than the groove 84 close to the ends along a direction orthogonal to the circumferential direction of the intermediate transfer belt 8. That is, the groove-depth becomes deeper as closer to both ends of the electrophotographic belt. Furthermore, the depth of the grooves 84 preferably lies in a range of 0.2 μm or more and 3.0 μm or less.

Furthermore, when average values of widths of the grooves 84 in the both ends areas are defined as We1 and We2 respectively, and an average value of widths of the grooves 84 in the central area is defined as Wm, Wm, We1, and We2 preferably satisfy equations (3) and (4):

$$Wm<We1 \quad (3)$$

$$Wm<We2 \quad (4).$$

That is, the average value of the width of the grooves 84 in the both ends areas is preferably greater than the average value of the width of the grooves 84 in the central area. In particular, the widths W of the grooves 84 are preferably greater for the grooves 84 close to the ends of the intermediate transfer belt 8 in the width direction.

The grooves 84 are preferably formed to include an area $W_c$ over which the cleaning blade 21 is in contact with the intermediate transfer belt 8.

The sliding properties of the sliding between the intermediate transfer belt 8 and the cleaning blade 21 are desirably uniform across the whole contact width. Hence, the cross-sectional shape of the grooves 84 in the width direction of the intermediate transfer belt 8 is more preferably a V shape. Because the cross-sectional shape of the grooves 84 in the width direction is a V shape, the groove width becomes wider as the groove depth deepens. That is, the area of contact with the cleaning blade 21 grows smaller at the ends of the intermediate transfer belt 8 which has a deep groove depth. Thus, the frictional force can be reduced at the ends, enabling uniform sliding characteristics that negate the pressing characteristic of the cleaning blade 21, which is particularly preferable. With regard to the cross-sectional shape being a V shape, the grooves 84 may have a width that narrows toward the bottom, and the cross-sectional shape of the grooves 84 may be a triangular shape or a trapezoidal shape.

Figure 1:
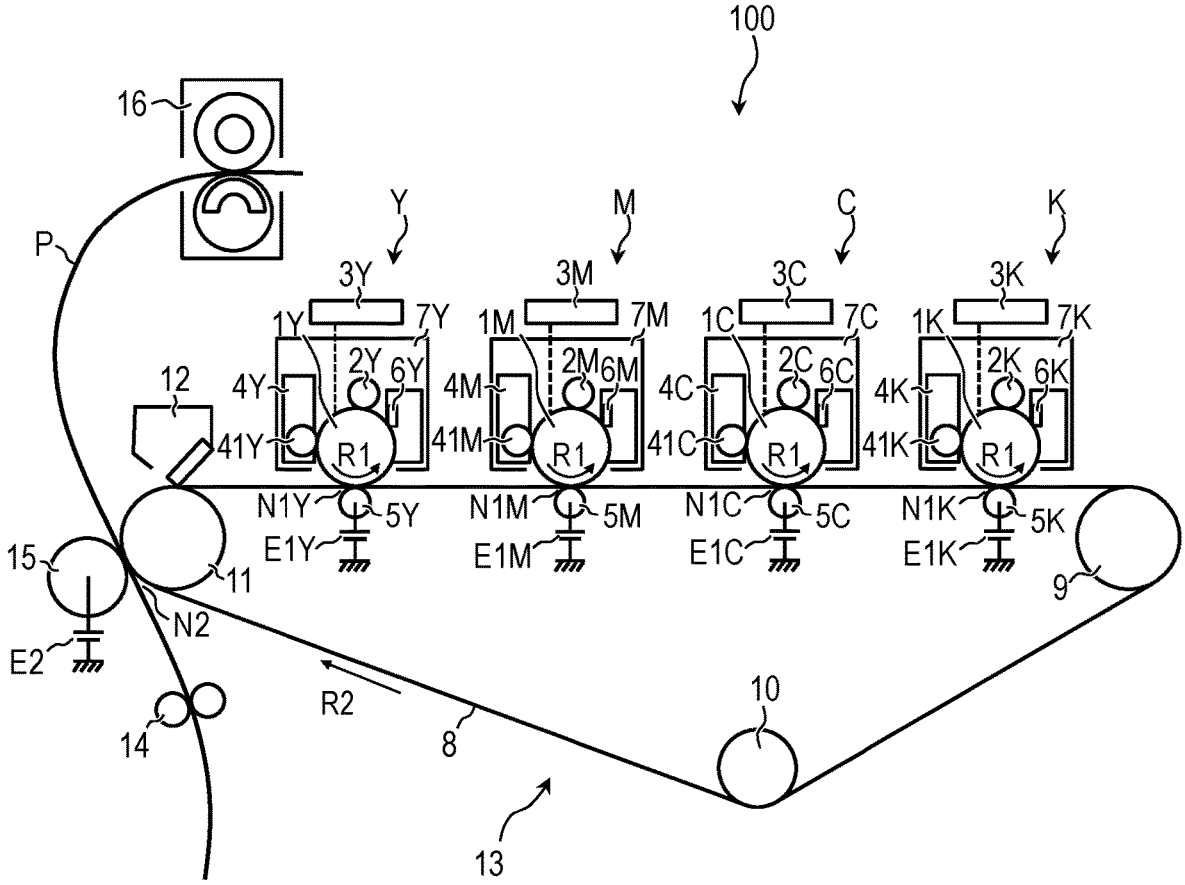
FIG. 1 is a schematic cross-sectional view illustrating an example of an electrophotographic image forming apparatus according to an embodiment of the present disclosure.

2. Overall Configuration and Operation of Electrophotographic Image Forming Apparatus FIG. 1 is a schematic cross-sectional view illustrating a general configuration for an electrophotographic image forming apparatus 100 that constitutes an example of the electrophotographic image forming apparatus according to another embodiment of the present disclosure. The electrophotographic image forming apparatus 100 is a tandem-type laser beam printer that utilizes an intermediate transfer system enabling full-color images to be formed using an electrophotographic system.

The electrophotographic image forming apparatus 100 has four image-forming units Y, M, C, and K arranged in a line, at fixed intervals. The image-forming units Y, M, C, and K each form images in the colors yellow (Y), magenta (M), cyan (C), and black (K), respectively. Note that, in the electrophotographic image forming apparatus 100, the respective configurations and operation of the image-forming units Y, M, C, and K are substantially the same except that the toner colors used are different.

The image-forming units Y, M, C, and K have photosensitive drums 1Y, 1M, 1C, and 1K which are drum type (cylindrical) electrophotographic photoreceptors (photoreceptors) constituting image carriers. The photosensitive drums 1Y, 1M, 1C, and 1K are OPC photosensitive drums and are rotationally driven in the direction of the arrows R1 in FIG. 1. Each of the following units is arranged in order along the direction of rotation in the periphery of the photosensitive drums 1Y, 1M, 1C, and 1K. First, charging rollers 2Y, 2M, 2C, and 2K, which are roller-shaped charging rollers that constitute electrification units, are arranged. Next, exposing devices 3Y, 3M, 3C, and 3K, which constitute exposing units, are arranged. Then developing devices 4Y, 4M, 4C, and 4K, which constitute developing units, are arranged. Thereafter, primary transfer rollers 5Y, 5M, 5C, and 5K, which are roller-shaped primary transfer members constituting primary transfer units, are arranged. Next, drum-cleaning devices 6Y, 6M, 6C, and 6K, which constitute image carrier cleaning units are arranged.

The developing devices 4Y, 4M, 4C, and 4K contain, as developer, a non-magnetic, one-component developer and have developing sleeves 41Y, 41M, 41C, and 41K, respectively, which constitute developer carriers, and developer application blades constituting developer regulating units, and the like. The photosensitive drums 1Y, 1M, 1C, and 1K, the charging rollers 2Y, 2M, 2C, and 2K, the developing devices 4Y, 4M, 4C, and 4K, and the drum-cleaning devices 6Y, 6M, 6C, and 6K integrally constitute process cartridges 7Y, 7M, 7C, and 7K. The process cartridges 7Y, 7M, 7C, and 7K are detachably attachable to the device main body of the electrophotographic image forming apparatus 100. Furthermore, the exposing devices 3Y, 3M, 3C, and 3K are configured from a scanner unit that causes a laser beam to perform scanning by means of a polygon mirror, and projects a scanning beam, which is modulated on the basis of an image signal, onto the photosensitive drums 1Y, 1M, 1C, and 1K.

Furthermore, the electrophotographic image forming apparatus 100 includes the intermediate transfer belt 8 which is an example of the electrophotographic belt having an endless shape according to the one embodiment of the present disclosure described earlier.

The intermediate transfer belt 8 is disposed so as to be in contact with all the photosensitive drums 1Y, 1M, 1C, and 1K of the respective image-forming units Y, M, C, and K. The intermediate transfer belt 8 is supported by three rollers (tension rollers), namely, a drive roller 9, a tension roller 10, and a secondary transfer-opposing roller 11, thereby maintaining a predetermined tension. As a result of the drive roller 9 being rotationally driven, the intermediate transfer belt 8 moves (rotates) in the direction of the arrows R2 in FIG. 1 (in the belt conveyance direction).

In the electrophotographic image forming apparatus 100, the intermediate transfer belt 8 moves at substantially the same speed in a forward direction with respect to the photosensitive drums 1Y, 1M, 1C, and 1K, in a section opposite the photosensitive drums 1Y, 1M, 1C, and 1K. On the inner circumferential surface side of the intermediate transfer belt 8, the foregoing primary transfer rollers 5Y, 5M, 5C, and 5K are each arranged in positions opposing the respective photosensitive drums 1Y, 1M, 1C, and 1K.

The primary transfer rollers 5Y, 5M, 5C, and 5K are biased (pressed) by a predetermined pressure against the photosensitive drums 1Y, 1M, 1C, and 1K, via the intermediate transfer belt 8. Further, the primary transfer rollers 5Y, 5M, 5C, and 5K form the primary transfer sections (primary transfer nips) N1Y, N1M, N1C, and N1K in which the photosensitive drums 1Y, 1M, 1C, and 1K contact the intermediate transfer belt 8.

Furthermore, on the outer circumferential surface side of the intermediate transfer belt 8, a secondary transfer roller 15, which is a roller-shaped secondary transfer member constituting a secondary transfer unit, is disposed in a position opposite the secondary transfer-opposing roller 11. The secondary transfer roller 15 is biased (pressed) by a predetermined pressure against the secondary transfer-opposing roller 11 via the intermediate transfer belt 8, and a secondary transfer section (secondary transfer nip) N2, at which the secondary transfer roller 15 contacts the intermediate transfer belt 8, is formed. Furthermore, on the outer circumferential surface side of the intermediate transfer belt 8, a belt cleaning device 12, which constitutes an intermediate transfer body cleaning unit, is disposed in a position opposite the secondary transfer-opposing roller 11. The intermediate transfer belt 8 supported by the foregoing three rollers 9, 10, and 11 and the belt cleaning device 12 are unitized, thereby constituting an intermediate transfer belt unit 13 that is detachably attachable to the device main body of the electrophotographic image forming apparatus 100.

When the image forming operation is started, each of the photosensitive drums 1Y, 1M, 1C, and 1K and the intermediate transfer belt 8 start rotating in the directions of the arrows R1 and R2 in FIG. 1, respectively, at a predetermined processing speed (circumferential speed). The surfaces of the rotating photosensitive drums 1Y, 1M, 1C, and 1K are substantially uniformly charged at a predetermined polarity (a negative polarity in the electrophotographic image forming apparatus 100) by the charging rollers 2Y, 2M, 2C, and 2K. At such time, a predetermined charging bias is applied to the charging rollers 2Y, 2M, 2C, and 2K from a charging power source that constitutes a charging bias application unit (not illustrated).

Thereafter, the charged surfaces of the photosensitive drums 1Y, 1M, 1C, and 1K are exposed by scanning beams from the exposing devices 3Y, 3M, 3C, and 3K, respectively, according to image information corresponding to the respective image-forming units Y, M, C, and K. Electrostatic images (electrostatic latent images) that correspond to the image information are thus formed on the respective surfaces of the photosensitive drums 1Y, 1M, 1C, and 1K.

Subsequently, the electrostatic images formed on the photosensitive drums 1Y, 1M, 1C, and 1K are developed by the developing devices 4Y, 4M, 4C, and 4K as toner images by means of the color toners corresponding to the respective image-forming units Y, M, C, and K.

Here, the toners in the developing devices 4Y, 4M, 4C, and 4K are charged at a negative polarity by a developer application blade (not illustrated) and applied to the developing sleeves 41Y, 41M, 41C, and 41K. Furthermore, a predetermined developing bias is applied to the developing sleeves 41Y, 41M, 41C, and 41K by a developing power source that constitutes a developing bias application unit (not illustrated). Then, the electrostatic images formed on the photosensitive drums 1Y, 1M, 1C, and 1K reach a section (developing section) opposite the photosensitive drums 1Y, 1M, 1C, and 1K and the developing sleeves 41Y, 41M, 41C, and 41K. Here, the electrostatic images on the photosensitive drums 1Y, 1M, 1C, and 1K are made visible by means of the negative polarity toners, and toner images are formed on the photosensitive drums 1Y, 1M, 1C, and 1K.

Thereafter, the toner images formed on the photosensitive drums 1Y, 1M, 1C, and 1K are transferred (primary transfer) to the intermediate transfer belt 8 which is being rotationally driven by the action of the primary transfer rollers 5Y, 5M, 5C, and 5K in the primary transfer sections N1Y, N1M, N1C, and N1K, respectively. At such time, a primary transfer bias is applied to the primary transfer rollers 5Y, 5M, 5C, and 5K from respective primary transfer power sources E1Y, E1M, E1C, and E1K, which constitute primary transfer bias application units. The primary transfer bias is a DC voltage of a polarity (positive polarity in the electrophotographic image forming apparatus 100) which is the opposite of the polarity for charging the toners during development. For example, when forming the full-color images, electrostatic images are formed on the photosensitive drums 1Y, 1M, 1C, and 1K with a certain timing lag according to the distances between the primary transfer sections N1Y, N1M, N1C, and N1K for each color, and the electrostatic images are developed, thereby producing the toner images. Further, the toner images of each color which are formed on the photosensitive drums 1Y, 1M, 1C, and 1K of the respective image-forming units Y, M, C, and K are superposed sequentially on the intermediate transfer belt 8 in the respective primary transfer sections N1Y, N1M, N1C, and N1K. Multiple toner images in four colors are thus formed on the intermediate transfer belt 8.

In addition, in accordance with the formation of the electrostatic images through exposure, a transfer material P such as recording paper or the like which is loaded in a transfer material storage cassette (not illustrated) is picked up by a transfer material supply roller (not illustrated) and conveyed by a conveyance roller (not illustrated) to the registration roller 14. The transfer material P is conveyed by the registration roller 14 to the secondary transfer section N2 formed by the intermediate transfer belt 8 and the secondary transfer roller 15, in synchronization with the toner images on the intermediate transfer belt 8.

The multiple toner images in four colors carried on the intermediate transfer belt 8 as described earlier, for example, are then transferred (secondary transfer) altogether to the transfer material P by the action of the secondary transfer roller 15 in the secondary transfer section N2. At such time, a secondary transfer bias, which is a DC voltage of a polarity (positive polarity in the electrophotographic image forming apparatus 100) which is the opposite of the polarity for charging the toners during development, is applied to the secondary transfer roller 15 from a secondary transfer power source E2 constituting a secondary transfer bias application unit.

Thereafter, the transfer material P to which the toner images have been transferred is conveyed to a fixing device 16 constituting a fixing unit. The transfer material P is then sandwiched between a pressure roller and the fixing roller of the fixing device 16 and pressurized and heated in the process of being conveyed, thereby fixing the toner images on the transfer material P. The transfer material P to which the toner images have been fixed is ejected from the device main body of the electrophotographic image forming apparatus 100 as an image-formed article.

Furthermore, in the primary transfer sections N1Y, N1M, N1C, and N1K, the toner that remains on the photosensitive drums 1Y, 1M, 1C, and 1K instead of being transferred to the intermediate transfer belt 8 (the primary transfer residual toner) is removed and recovered by the drum-cleaning devices 6Y, 6M, 6C, and 6K. Likewise, the toner that remains on the intermediate transfer belt 8 instead of being transferred to the transfer material P (secondary transfer residual toner) in the secondary transfer section N2 is removed and recovered from the intermediate transfer belt 8 by the belt cleaning device 12.

3. Belt Cleaning Device

Figure 2:
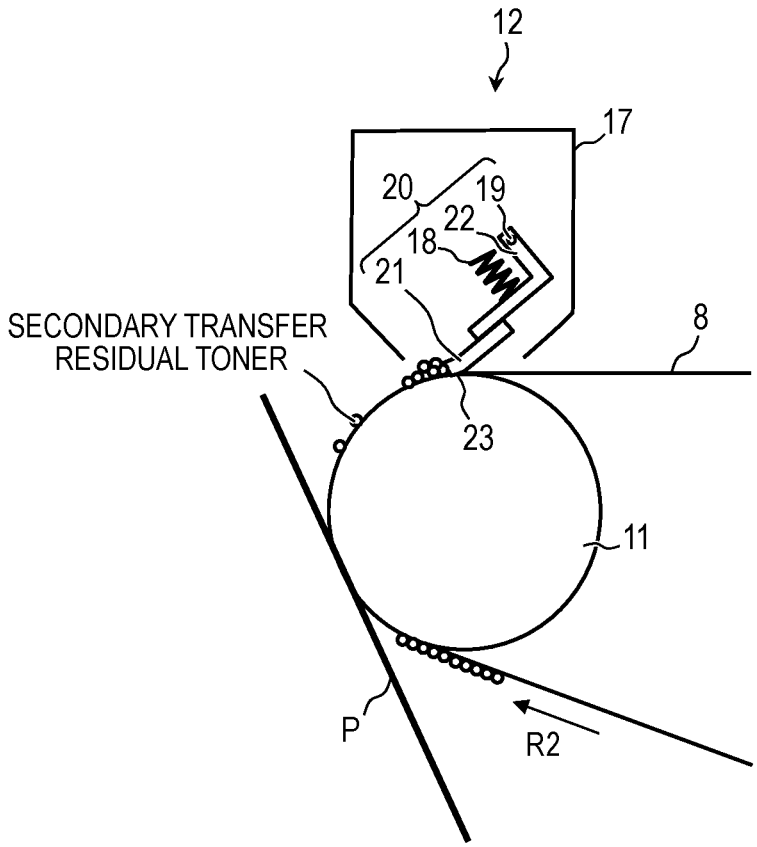
FIG. 2 is a schematic cross-sectional view illustrating the vicinity of a belt cleaning device.

FIG. 2 is a principal cross-sectional view illustrating the vicinity of the belt cleaning device 12.

The belt cleaning device 12 has a cleaning container 17 and a cleaning action part 20 provided in the cleaning container 17. The cleaning container 17 is constituted as part of a frame body (not illustrated) of the intermediate transfer belt unit 13. The cleaning action part 20 includes the cleaning blade 21, which constitutes a cleaning member, and a supporting member 22 that supports the cleaning blade 21. The cleaning blade 21 is an elastic blade (rubber part) for which urethane rubber (polyurethane), which is an elastic material, is used as the material, for example. Furthermore, the supporting member 22 is formed from sheet metal for which a plated sheet steel is used as the material, for example (sheet metal portion). The cleaning blade 21 is fastened to the supporting member 22 to constitute the cleaning action part 20.

The cleaning blade 21 is a plate-like member of a predetermined thickness which is long in one direction. The cleaning blade 21 has, of two substantially orthogonal sides, one side in the longitudinal direction that extends along a direction which is substantially orthogonal to the belt conveyance direction (hereinafter also called the "thrust direction"), and a side in the short-side direction, one end side of which is in contact with the intermediate transfer belt 8.

The cleaning action part 20 is configured to be pivotable. That is, the supporting member 22 is pivotably supported via a pivot shaft 19 fixed to the cleaning container 17. As a biasing unit provided in the cleaning container 17, the supporting member 22 is pressed by the pressure springs 18 such that the cleaning action part 20 turns about the pivot shaft 19 and the cleaning blade 21 is biased (pressed) against the intermediate transfer belt 8.

The pressure springs 18 are disposed at both longitudinal ends of the supporting member 22, and the cleaning blade 21 is pressed against the intermediate transfer belt 8. The secondary transfer-opposing roller 11 is disposed opposite the cleaning blade 21, on the inner side of the intermediate transfer belt 8. The cleaning blade 21 is in contact with the intermediate transfer belt 8 in one direction counter to the belt conveyance direction. In other words, the cleaning blade 21 is in contact with the surface of the intermediate transfer belt 8 such that the tip of the free end side in the short-side direction faces the upstream side in the belt conveyance direction. A blade nip section 23 is thus formed between the cleaning blade 21 and the intermediate transfer belt 8. The cleaning blade 21 recovers toner that remains on the outer circumferential surface of the moving intermediate transfer belt 8, in the blade nip section 23.

For example, the attachment position of the cleaning blade 21 is set as follows. A set angle θ is 24°, an amount of penetration δ is 1.5 mm, and the pressing force is 0.6 N/cm. Here, the set angle θ is an angle formed between the intermediate transfer belt 8 and the cleaning blade 21.

Further, the amount of penetration δ is the length in the normal direction of the overlap between the free end of the cleaning blade 21 and the intermediate transfer belt 8. For example, the thickness of the cleaning blade 21 is 2 mm, the length in the thrust direction is 245 mm, and the hardness of the cleaning blade 21 is 77 degrees according to the JIS K 6253 standard. When the thrust direction length of the intermediate transfer belt 8 is 250 mm, the cleaning blade 21 is disposed so as to be in contact, across its whole width, with the outer circumferential surface of the intermediate transfer belt 8. Furthermore, the pressing force from the cleaning blade 21 in the blade nip section 23 is defined by a linear load in the longitudinal direction and is measured using a film pressure measurement system (product name: PINCH, manufactured by Nitta), for example. By setting the attachment position of the cleaning blade 21 as described hereinabove, burring of the cleaning blade 21 and slip noise in a high-temperature, high-humidity environment (30° C./80%) can be suppressed, and a favorable cleaning performance can be obtained. In addition, by means of the above settings, inferior cleaning in a low-temperature, low-humidity environment (15° C./10%) can be suppressed, and a favorable cleaning performance can be obtained.

Furthermore, the frictional resistance caused by the sliding of urethane rubber against synthetic resin is generally large, and an initial burring of the cleaning blade 21 readily arises. Therefore, an initial lubricant such as graphite fluoride can be pre-applied to the tip on the free end side of the cleaning blade 21.

According to one embodiment of the present disclosure, an electrophotographic belt that, despite long-term usage, is not susceptible to unevenness in cleaning by a cleaning blade in a width direction can be obtained. Furthermore, according to another embodiment of the present disclosure, an electrophotographic image forming apparatus that enables high-quality electrophotographic images to be formed stably over long periods can be obtained.

EXAMPLES

Example 1

[Manufacturing of Intermediate Transfer Belt Base Layer]

A seamless base layer was obtained by passing through a three-stage heat molding process.

First, as a first-stage heat molding process, a biaxial extruder (product name: TEX30α, manufactured by Nippon Steel (Corp.)) was used. The base layer materials hereinbelow were then melted and kneaded in the ratio PEN/PEEA/CB=84/15/1 (mass ratio) to prepare a thermoplastic resin composition.

PEN: Polyethylene naphthalate (product name: TN-8050SC, manufactured by Teijin Corp.);

PEEA: Polyether ester amide (product name: PELESTAT NC6321, manufactured by Sanyo Chemical Industries (Ltd.));

CB: Carbon black (product name: MA-100, manufactured by Mitsubishi Chemical (Corporation))

The temperature of the melting and kneading was adjusted to within a range of 260° C. or more and 280° C. or less, and the melting and kneading time was approximately 3 to 5 minutes. The thermoplastic resin composition thus obtained was pelletized and desiccated at a temperature of 140° C. for six hours.

As a second-stage heat molding process, the foregoing desiccated and pelletized thermoplastic resin composition was introduced to an injection molding device (product name: SE180D, manufactured by Sumitomo Heavy Industries (Ltd.)). The cylinder set temperature was set at 295° C. and the mold temperature was adjusted to 30° C., whereby a preform was produced. The preform thus obtained was afforded a test-tube shape with an outer diameter of 50 mm, an inner diameter of 46 mm, and a length of 100 mm.

Figure 6A:
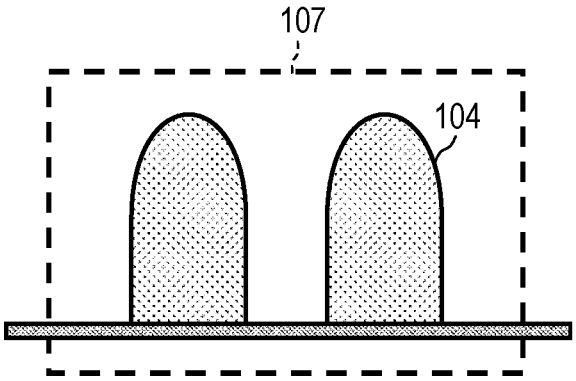
FIG. 6A is a schematic diagram illustrating an example of a method for manufacturing an intermediate transfer belt base layer using a stretch blow molding machine, and is a diagram illustrating a preform heating process.
Figure 6B:
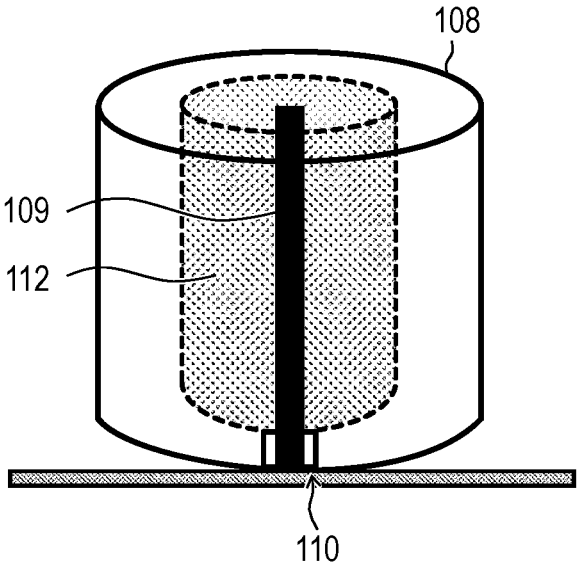
FIG. 6B is a schematic diagram illustrating an example of a method for manufacturing an intermediate transfer belt base layer using a stretch blow molding machine, and is a diagram illustrating a preform stretching process.

As a third-stage heat molding process, the foregoing preform was biaxially oriented using the biaxial orientation device (the stretch blow molding machine) illustrated in FIGS. 6A and 6B. Prior to the biaxial orientation, as illustrated in FIG. 6A, a preform 104 is disposed in a heating device 107 including a non-contact heater (not illustrated) for heating the outer wall and inner wall of the preform 104, and the outer surface temperature of the preform was heated by the heater to 150° C. Thereafter, as illustrated in FIG. 6B, the heated preform 104 is disposed in a blow mold 108 held at 30° C. and stretched in an axial direction using an extension rod 109. At the same time, air which has been temperature-controlled to a temperature of 23° C. is introduced to the preform from a blow air injection part 110, thereby extending the preform 104 in a radial direction. The preform 104 was extracted from the blow mold 108, and a bottle-like molded article 112 was obtained.

An intermediate transfer belt base layer 81 with a seamless endless shape was obtained by cutting off the body section of the bottle-like molded article 112 thus obtained. The thickness of the base layer 81 of the intermediate transfer belt 8 was 70.2 μm, the circumferential length was 712.2 mm, and the width was 250.0 mm.

[Manufacturing of the Surface Layer of the Intermediate Transfer Belt]

The surface layer materials hereinbelow were added in the ratio (mass ratio in terms of solid content) AN/PTFE/GF/SL/IRG=66/20/1.0/12/1.0, and a solution that had undergone processing to roughly disperse the materials except the SL was initially prepared. A dispersion was obtained by dispersing the solution until a 50% PTFE average particle diameter reached 200 nm by using a high-pressure emulsifier/disperser (product name: NanoVater, manufactured by Yoshida Machinery Co. (Ltd.)).

- AN: Dipentaerythritol penta-/hexa-acrylate (product name: ARONIX M-402, manufactured by Toagosei Co. (Ltd.));
- PTFE: PTFE particles (product name: Lubron L-2, manufactured by Daikin Industries (Ltd.));
- GF: PTFE particle dispersant (product name: GF-300, manufactured by Toagosei Co. (Ltd.));
- SL: zinc antimonate particle slurry (product name: Celnax CX-Z400K, manufactured by Nissan Chemical (Corporation), 40% by mass of zinc antimonate particle component); and
- IRG: photopolymerization initiator (product name: Irgacure 907, manufactured by BASF Corporation)

Thereafter, the dispersion was dripped into a stirred SL to obtain a coating liquid for forming the surface layer. Note that the PTFE particle diameter in the coating liquid was measured using a fiber-optics particle analyzer (product name: FPAR-1000, manufactured by Otsuka Electronics Co. (Ltd.)) on the basis of Dynamic Light Scattering (DLS) technology (ISO-DIS22412 standard).

The base layer obtained through blow molding was fitted into the outer circumference of a cylindrical mold, the ends of which were sealed, before being immersed, together with the mold, in a container full of the coating liquid for forming the surface layer. Thereafter, pulling is performed so that the relative speed of the base layer and the liquid level of the coating liquid for forming the surface layer is constant, thereby forming a coating film, which is formed from the coating liquid for forming the surface layer, on the base layer surface.

Note that the film thickness can be varied by adjusting the pulling speed (the relative speed of the liquid level of the curable composition and the base layer) and the solvent ratio of the curable composition.

In the present example, the pulling speed was set at 10 to 50 mm/second. After forming the coating film and then desiccating the coating film for one minute at 23° C. and a reduced pressure, the coating film was cured using a UV irradiator (product name: UE06/81-3, manufactured by iGrafx (LLC)) to irradiate the coating film with ultraviolet rays up to a cumulative amount of light of 600 mJ/cm$^2$. The thickness of the surface layer of the intermediate transfer belt 8 with an endless shape thus obtained was 3.0 μm as a result of observing the cross-section using an electron microscope (product name: XL30-SFEG, manufactured by FEI Company (Inc.)).

[Formation of Grooves in Intermediate Transfer Belt Surface]

Figure 7:
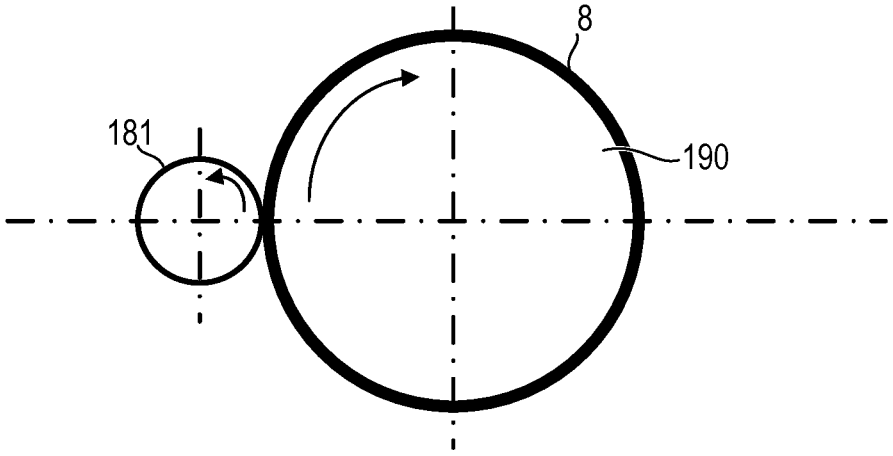
FIG. 7 is a schematic diagram illustrating a configuration of an imprint process apparatus that forms grooves in the surface of an intermediate transfer belt.

An imprint process apparatus, which is illustrated in FIG. 7, was used to form the grooves 84 in a prepared intermediate transfer belt 8.

The imprint process apparatus is configured from a cylindrical mold 181 and a cylindrical belt-holding mold 190, and the cylindrical mold 181 can be pressurized in a state where its shaft is kept parallel to the cylindrical belt-holding mold 190. At such time, the cylindrical mold 181 and the cylindrical belt-holding mold 190 rotate in sync with each other without slipping. The cylindrical mold 181 has a diameter of 120 mm and a width of 270 mm, and cutting work is used to form, in the outer surface thereof and in a full-width direction, protrusions (protrusion height of 3.5 μm, a protrusion bottom width of 2.0 μm, and an apex section width of 0.2 μm) that extend in all circumferential directions, at a pitch of 20 μm. The intermediate transfer belt 8 has a width of 250 mm, and hence the intermediate transfer belt 8 can be brought into contact, across its whole width, with the cylindrical mold 181.

The cylindrical mold 181 includes a pressurization mechanism (not illustrated) at both ends and is designed to be elastically deformed moderately to the extent that a center section thereof shifts to a position spaced apart by 2 μm from a straight line linking the two ends when the two ends are pressed by a force of 17 kN. Furthermore, a cartridge heater is embedded in the cylindrical mold 181, thereby enabling uniform heating to a desired temperature.

The intermediate transfer belt 8 is mounted on the outer circumference of the cylindrical belt-holding mold 190 (circumferential length of 712.0 mm). The cylindrical mold 181 heated to 130° C. is pressed via a pressing force of 17 kN against the cylindrical belt-holding mold on the outer circumference of which the intermediate transfer belt 8 is mounted, while keeping the shaft centerlines thereof parallel to each other, and with this state still maintained, the cylindrical belt-holding mold 190 and the cylindrical mold 181 are rotated together in opposite directions to each other at a circumferential speed of 30 mm/sec.

Further, after being made to contact the cylindrical mold 181, the intermediate transfer belt 8 is spaced apart therefrom up to a point slightly exceeding the thickness of one circumference (equivalent to 1 mm). Thus, grooves 84 like those illustrated in FIG. 3 are formed over the whole surface of the intermediate transfer belt 8, thereby producing the intermediate transfer belt 8 according to Example 1 (hereinafter called "intermediate transfer belt No. 1").

<Measurement of Groove Depth and Groove Width>

The depth and width of the grooves in intermediate transfer belt No. 1 thus obtained were measured as follows.

The width in a direction orthogonal to the circumferential direction of the groove-formed area of the intermediate transfer belt was 250 mm, which is the same as the width of the belt itself. Therefore, the groove-formed area was divided into three areas with a width of 83.3 mm, that is, a central area and end areas, and the average value of the depth of the groove and the average value of the width of the groove were determined for each area.

More specifically, a laser microscope (product name: VertScan, manufactured by Mitsubishi Chemical Systems (Inc.)) was used to observe any three points of each area, that is, a total of nine points, using magnification whereby at least ten grooves are observed in the visual field. The groove depth and groove width were measured for the ten grooves in each of the three points in the respective areas. That is, a profile curve was extracted by combining evaluation lines in a direction orthogonal to the grooves from the observed perspective, and a straight line calculated using the least-squares method from the profile curve excluding the groove sections was taken as the surface boundary. Furthermore, taking the surface boundary as a reference, the depth of the deepest section of each groove section was used as the groove depth, and the distance between two points where the profile curve crosses the surface boundary in each groove section was measured as the groove width. Thereafter, arithmetic average values for the groove depth and groove width obtained for each of the ten grooves in each area were calculated, thereby obtaining average values (Dm, De1, and De2) for the groove depth and average values (Wm, We1 and We2) for the groove width, in each area.

<Evaluation of Coefficient of Dynamic Friction>

The coefficient of dynamic friction of the surface layer of the intermediate transfer belt No. 1 was evaluated by means of the following method.

A surface property tester (the "Heidon 14FW" manufactured by Shinto Scientific Co., Ltd.) was used for the frictional force measurement. As a measuring indenter, a ball indenter made of urethane rubber (outer diameter of ⅜ inches, rubber hardness of 90 degrees) was used, and the measurement conditions were a test load of 50 gf for the central area, a test load of 55 gf for the end areas, a speed of 10 mm/sec and a measurement distance of 50 mm. A value obtained by dividing the average value of the frictional force (go measured from 0.4 to 1 second after the start of measurement by the test load (go was used as the coefficient of dynamic friction μ1 (central area) and μ2 (end areas).

<Evaluation of Cleaning Properties>

The electrophotographic image forming apparatus with the configuration illustrated in FIG. 1 was used, intermediate transfer belt No. 1 was installed, an image was printed, and the cleaning properties were evaluated.

In an environment with a temperature of 15° C. and a relative humidity of 10%, printing was performed using an A4 paper size (product name: Extra, manufactured by Canon, basis weight of 80 g/m2) as the transfer material P, and the existence of toner slippage past the cleaning blade was checked.

More specifically, in a state where the secondary transfer voltage was off (0V), a red image (yellow toner, magenta toner) was printed across the whole A4 sheet area, and subsequently three sheets were made to pass through continuously as blank sheets by setting the secondary transfer voltage at a suitable value. All three sheets are output as blank sheets if cleaning has been successful, but if toner has slipped past the cleaning blade, the sheets are not blank, and an image is output. A case where toner slippage has been confirmed is considered to be a toner cleaning defect and was evaluated using the following reference points.

Rank A: over the course of 200,000 sheets of paper, a toner cleaning defect did not occur.

Rank B: over the course of 150,000 sheets of paper, a toner cleaning defect occurred.

Rank C: over the course of 100,000 sheets of paper, a toner cleaning defect occurred.

Rank D: over the course of 50,000 sheets of paper, a toner cleaning defect occurred.

Examples 2 and 3

Except for the pressing force of the cylindrical mold 181 in the formation of the surface layer grooves being made 15 kN in Example 2 and 30 kN in Example 3, intermediate transfer belt Nos. 2 and 3 pertaining to Examples 2 and 3, respectively, were produced in the same way as Example 1. For the intermediate transfer belt Nos. 2 and 3 thus obtained, the groove depth and groove width were measured as for the intermediate transfer belt No. 1, and the coefficient of dynamic friction of the surface and the cleaning properties were evaluated.

Examples 4 and 5

The protrusion pitch I of the cylindrical mold 181 is changed to 3 μm in Example 4 and 30 μm in Example 5. Further, the pressing force of the imprint process apparatus is suitably adjusted according to the pitch I. Otherwise, intermediate transfer belt Nos. 4 and 5 pertaining to Examples 4 and 5, respectively, were produced in the same way as Example 1. For the intermediate transfer belt Nos. 4 and 5 thus obtained, the groove depth and groove width were measured as for the intermediate transfer belt No. 1, and the coefficient of dynamic friction of the surface and the cleaning properties were evaluated.

Example 6

Figure 4:
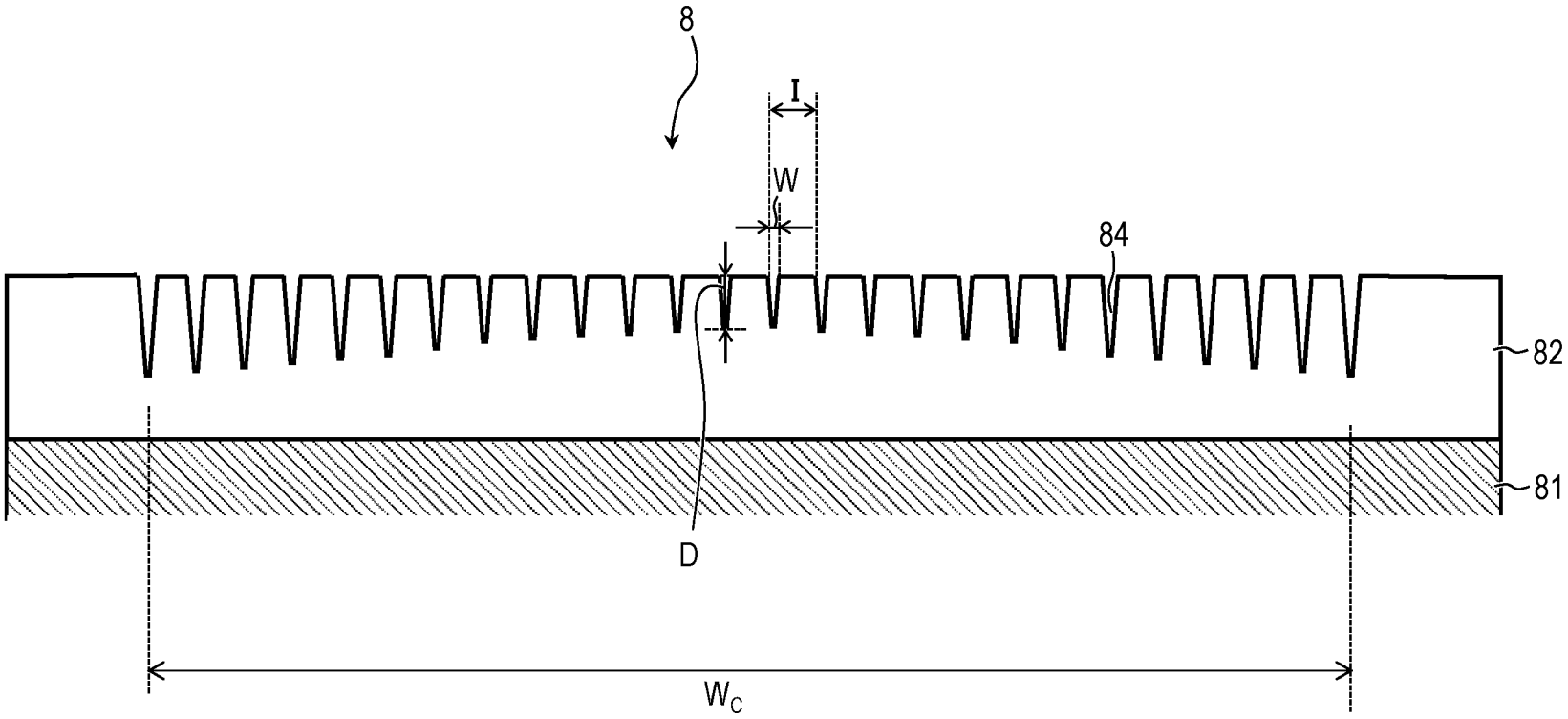
FIG. 4 is a schematic cross-sectional view illustrating an example of an electrophotographic belt having an endless shape according to one embodiment of the present disclosure.

Except for the length of the cylindrical mold 181 being set at 245 mm, which is the same as the length in the longitudinal direction of the cleaning blade 21, intermediate transfer belt No. 6 illustrated in FIG. 4 was produced in the same way as Example 1.

In Example 6, the grooves 84 were not formed in areas other than a region $W_c$ of contact by the cleaning blade 21. For the intermediate transfer belt No. 6 thus obtained, the groove depth and groove width were measured as for the intermediate transfer belt No. 1, and the coefficient of dynamic friction of the surface and the cleaning properties were evaluated.

Example 7

Figure 5:
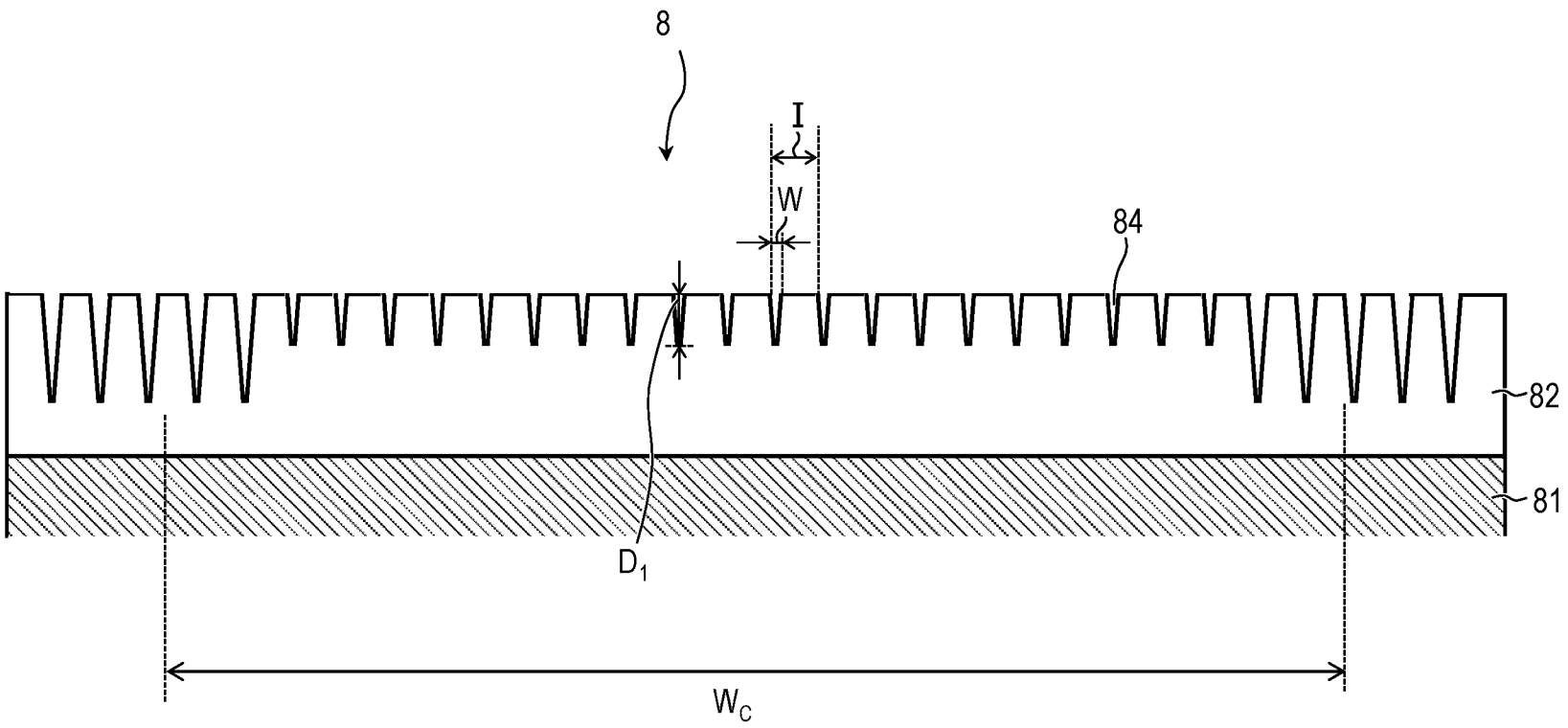
FIG. 5 is a schematic cross-sectional view illustrating an example of an electrophotographic belt having an endless shape according to one embodiment of the present disclosure.

The base layer and surface layer of the intermediate transfer belt were produced as per Example 1. Thereafter, the foregoing imprint process apparatus was used, the length of the cylindrical mold 181 was set at 50 mm, and the groove 84 was formed five times in the width direction of the intermediate transfer belt. Intermediate transfer belt No. 7 pertaining to Example 7 as illustrated in FIG. 5 was thus produced. When the grooves 84 are formed in the areas at both ends of intermediate transfer belt No. 7, the cylindrical mold 181 was pressed by a pressing force of 5 kN, and when forming the grooves 84 in the middle section, a pressing force of 3 kN was used. For the intermediate transfer belt No. 7 thus obtained, the groove depth $D_1$ and groove width were measured as for the intermediate transfer belt No. 1, and the coefficient of dynamic friction of the surface and the cleaning properties were evaluated.

Comparative Example 1

Similarly to Example 7, the length of the cylindrical mold 181 was set at 50 mm, and the groove 84 was formed five times. At such time, the formation of five grooves 84 was performed using a uniform pressing force of 3 kN for all the grooves 84, thereby obtaining an intermediate transfer belt No. 8 pertaining to comparative example 1 illustrated in FIG. 8. For the intermediate transfer belt No. 8 thus obtained, the groove depth and groove width were measured as for the intermediate transfer belt No. 1, and the coefficient of dynamic friction of the surface and the cleaning properties were evaluated.

TABLE 1

Figure 8:
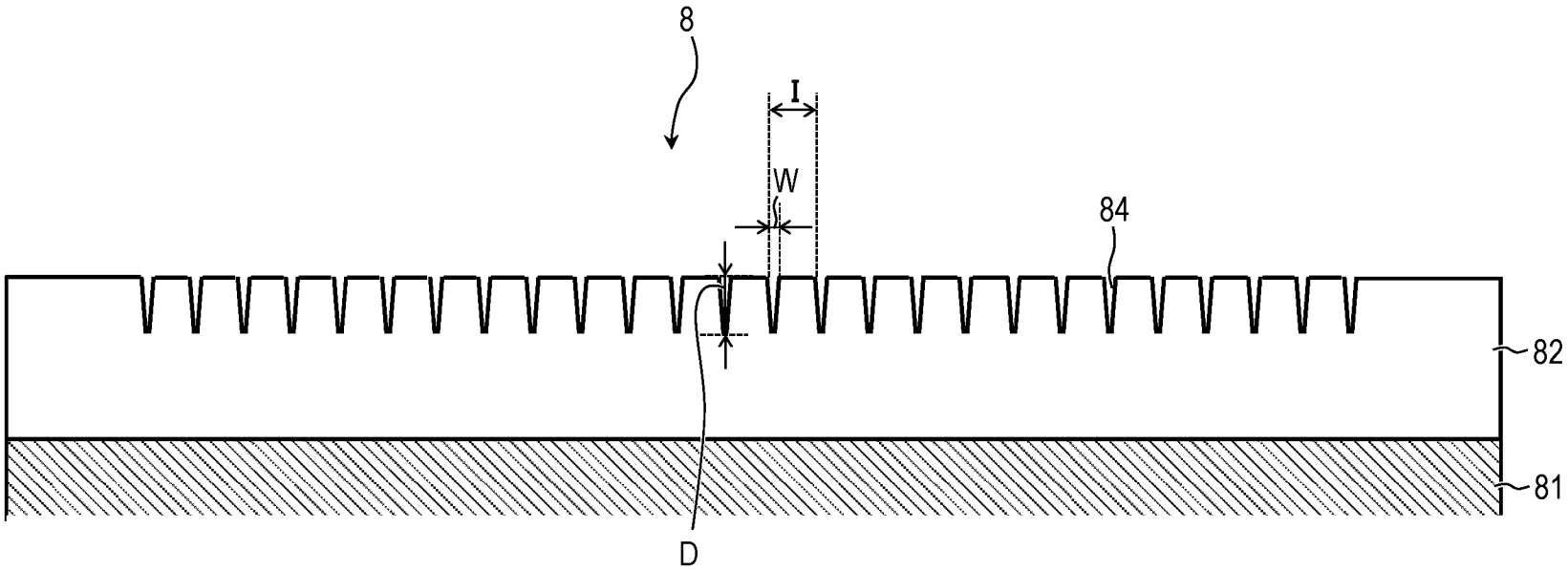
FIG. 8 is a schematic cross-sectional view of an intermediate transfer belt according to a comparative example.

| | | Example | | | | | | | Comparative |
|---|---|---|---|---|---|---|---|---|---|
| | | 1 | 2 | 3 | 4 | 5 | 6 | 7 | example 1 |
| Cross-section shape | | FIG. 3 | FIG. 3 | FIG. 3 | FIG. 3 | FIG. 3 | FIG. 4 | FIG. 5 | FIG. 8 |
| Pitch I (μm) | | 20 μm | 20 μm | 20 μm | 3 μm | 30 μm | 20 μm | 20 μm | 20 μm |
| Central area | Groove width average value (Wm) | 0.5 μm | 0.4 μm | 1.0 μm | 0.2 \μm | 1.0 μm | 0.5 μm | 0.5 μm | 0.5 μm |
| | Groove depth average value (Dm) | 0.5 μm | 0.4 μm | 1.0 μm | 0.2 μm | 1.0 μm | 0.5 μm | 0.5 μm | 0.5 μm |
| Right end area | Groove width average value (We1) | 0.7 μm | 0.6 μm | 1.4 μm | 0.3 μm | 2.0 μm | 0.7 μm | 0.7 μm | 0.5 μm |
| | Groove depth average value (De1) | 0.7 μm | 0.6 μm | 1.4 μm | 0.3 μm | 2.0 μm | 0.7 μm | 0.7 μm | 0.5 μm |
| Left end area | Groove width average value (We2) | 0.7 μm | 0.6 μm | 1.4 μm | 0.3 μm | 2.0 μm | 0.7 μm | 0.7 μm | 0.5 μm |
| | Groove depth average value (De2) | 0.7 μm | 0.6 μm | 1.4 μm | 0.3 μm | 2.0 μm | 0.7 μm | 0.7 μm | 0.5 μm |
| Full width of groove-fonned area | | 250 mm | 250 mm | 250 mm | 250 mm | 250 mm | 250 mm | 250 mm | 250 mm |
| Length ($W_c$) of cleaning blade in width direction | | 245 mm | 245 mm | 245 mm | 245 mm | 245 mm | 245 mm | 245 mm | 245 mm |
| Dynamic friction μ1 | | 0.7 | 0.72 | 0.67 | 0.65 | 0.68 | 0.7 | 0.7 | 0.7 |
| Dynamic friction μ2 | | 0.71 | 0.71 | 0.66 | 0.67 | 0.7 | 0.69 | 0.7 | 0.79 |
| Cleaning properties evaluation rank | | A | B | A | B | A | A | A | C |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-086279, filed Apr. 26, 2019, which is hereby incorporated by reference herein in its entirety.

What is claimed is:

1. An electrophotographic belt having an endless shape, comprising:

grooves on an outer circumferential surface thereof, the grooves each extending in a circumferential direction of the electrophotographic belt, wherein when equally dividing a groove-formed area of the outer circumferential surface into three areas in a direction orthogonal to the circumferential direction of the electrophotographic belt, Dm<De1 and Dm<De2 where Dm is an average value of depths of the grooves in a central area, and De1 and De2 are average values of depths of the grooves contained in both ends areas.

2. The electrophotographic belt according to claim 1, wherein the groove-depth becomes deeper closer in the direction orthogonal to the circumferential direction to both ends of the electrophotographic belt.

3. The electrophotographic belt according to claim 1, wherein groove-pitches in the direction orthogonal to the circumferential direction of the electrophotographic belt are in a range of 1 to 50 μm.

4. The electrophotographic belt according to claim 1, wherein groove-pitches in the direction orthogonal to the circumferential direction of the electrophotographic belt are constant.

5. The electrophotographic belt according to claim 1, wherein the grooves have a V-shaped cross-section in the direction orthogonal to the circumferential direction of the electrophotographic belt.

6. The electrophotographic belt according to claim 1, wherein the depths of the grooves are in a range of 0.2 to 3.0 μm.

7. The electrophotographic belt according to claim 1, wherein Wm<We1 and Wm<We2 when We1 and We2 are respectively average values of widths of the grooves in the both ends areas, and Wm is an average value of widths of the grooves in the central area.

8. The electrophotographic belt according to claim 1, wherein the electrophotographic belt is an intermediate transfer belt.

9. An electrophotographic image forming apparatus comprising:

an electrophotographic belt having an endless shape; and a cleaning member disposed in contact with an outer circumferential surface of the electrophotographic belt, the electrophotographic belt having grooves on the outer circumferential surface thereof, the grooves each extending in a circumferential direction of the electrophotographic belt, wherein when equally dividing a groove-formed area of the outer circumferential surface into three areas in a direction orthogonal to the circumferential direction of the electrophotographic belt, Dm<De1 and Dm<De2 where Dm is an average value of depths of the grooves in a central area, and De1 and De2 are average values of depths of the grooves contained in both ends areas.

10. The electrophotographic image forming apparatus according to claim 9, wherein the electrophotographic belt is an intermediate transfer belt.

* * * * *